US010519670B2

(12) United States Patent
Hennings

(10) Patent No.: US 10,519,670 B2
(45) Date of Patent: Dec. 31, 2019

(54) GUTTER EXTENSION FASTENING SYSTEM

(71) Applicant: Wade Hennings, Dysart, IA (US)

(72) Inventor: Wade Hennings, Dysart, IA (US)

( * ) Notice: Subject to any disclaimer, the term of this patent is extended or adjusted under 35 U.S.C. 154(b) by 0 days.

(21) Appl. No.: 15/988,797

(22) Filed: May 24, 2018

(65) Prior Publication Data

US 2018/0340335 A1 Nov. 29, 2018

Related U.S. Application Data

(60) Provisional application No. 62/510,975, filed on May 25, 2017.

(51) Int. Cl.

| | |
|---|---|
| ***E04D 13/08*** | (2006.01) |
| ***E04D 13/064*** | (2006.01) |
| ***E04D 13/076*** | (2006.01) |
| ***E04D 13/068*** | (2006.01) |
| ***E04D 13/04*** | (2006.01) |

(52) U.S. Cl.

CPC ..... *E04D 13/08* (2013.01); *E04D 13/04* (2013.01); *E04D 13/064* (2013.01); *E04D 13/068* (2013.01); *E04D 13/0645* (2013.01); *E04D 13/076* (2013.01); *E04D 2013/084* (2013.01); *E04D 2013/0846* (2013.01)

(58) Field of Classification Search

CPC ..... E04D 13/0645; E04D 2013/084; E04D 13/08; E04D 13/064; E04D 13/068; E04D 13/076; E04D 13/04; E04D 2013/0846

See application file for complete search history.

(56) References Cited

U.S. PATENT DOCUMENTS

| | | | | | |
|---|---|---|---|---|---|
| 269,126 | A * | 12/1882 | Shupe | E05D 3/02 16/390 |
| 2,648,054 | A * | 8/1953 | Berg | H01R 11/12 439/883 |
| 3,375,851 | A * | 4/1968 | Schif | E04D 13/08 137/120 |
| 3,911,954 | A * | 10/1975 | Johnson | E04D 13/08 137/615 |
| 4,270,572 | A * | 6/1981 | Jarzynka | E04D 13/08 137/615 |
| 2017/0152662 | A1* | 6/2017 | Elder | E04D 13/08 |

FOREIGN PATENT DOCUMENTS

| | | | | |
|---|---|---|---|---|
| CA | 2096294 | A1 * | 11/1994 | E04D 13/08 |
| WO | WO-2008036781 | A2 * | 3/2008 | A61C 7/00 |

* cited by examiner

*Primary Examiner* — Jessie T Fonseca

(74) *Attorney, Agent, or Firm* — Shuttleworth & Ingersoll, PLC; Brett Papendick

(57) ABSTRACT

A gutter fastening system for a building allows a downspout extension to be selectively attached to an elbow joint of a downspout. A plurality of mounting members that can be screws are screwed through the downspout and/or the downspout extension. A flexible elastic piece that serves as a linkage member is then placed on a first portion of the screws and secures the downspout extension to the downspout. The elastic piece is selectively removable from the downspout and the downspout extension allowing the downspout extension to be removed from the downspout.

13 Claims, 3 Drawing Sheets

GUTTER EXTENSION FASTENING SYSTEM

CROSS-REFERENCE TO RELATED APPLICATIONS

The present application claims priority to provisional patent application 62/510,975 which was filed on May 25, 2017, and is hereby expressly incorporated by reference in its entirety.

BACKGROUND OF THE INVENTION

Gutter systems are utilized to direct the flow of water from a roof of a building to the ground at specific locations. As part of the overall gutter system, downspouts can have extensions that run substantially perpendicular to the downspouts and parallel to the ground. These downspout extensions can be dislodged from the downspout during weather events such as heavy rain or wind. Additionally, if permanently attached, the downspout extension can be burdensome for maintaining surrounding landscapes and grass.

It is therefore an object of the invention to provide a system that can secure a downspout extension to a downspout.

It is further an object of the invention to provide a system that can be selectively attached to the downspout and the downspout extension.

SUMMARY OF THE INVENTION

The invention is a fastening system for a gutter downspout extension to a downspout. The system has parts that allow the downspout extension to be selectively removable from the elbow joint of a typical downspout found on both commercial and residential buildings.

Mounting members are mounted to the downspout extension and the downspout preferably at the elbow joint. The mounting members are outside the area of overlap of the elbow joint and the downspout extension. A portion of the mounting members remain on an exterior of the elbow joint and the downspout extension, accordingly they are accessible to a user of the system. A linkage member is then attached to the mounting members, thus securing the elbow joint to the downspout extension. The linkage member is flexible such that it can be removed easily so the user can remove the downspout extension at his or her discretion. The fastening system maintains a tension on the joint to prevent the downspout extension from disengaging from the elbow joint.

DETAILED DESCRIPTION OF THE INVENTION

Figure 1:
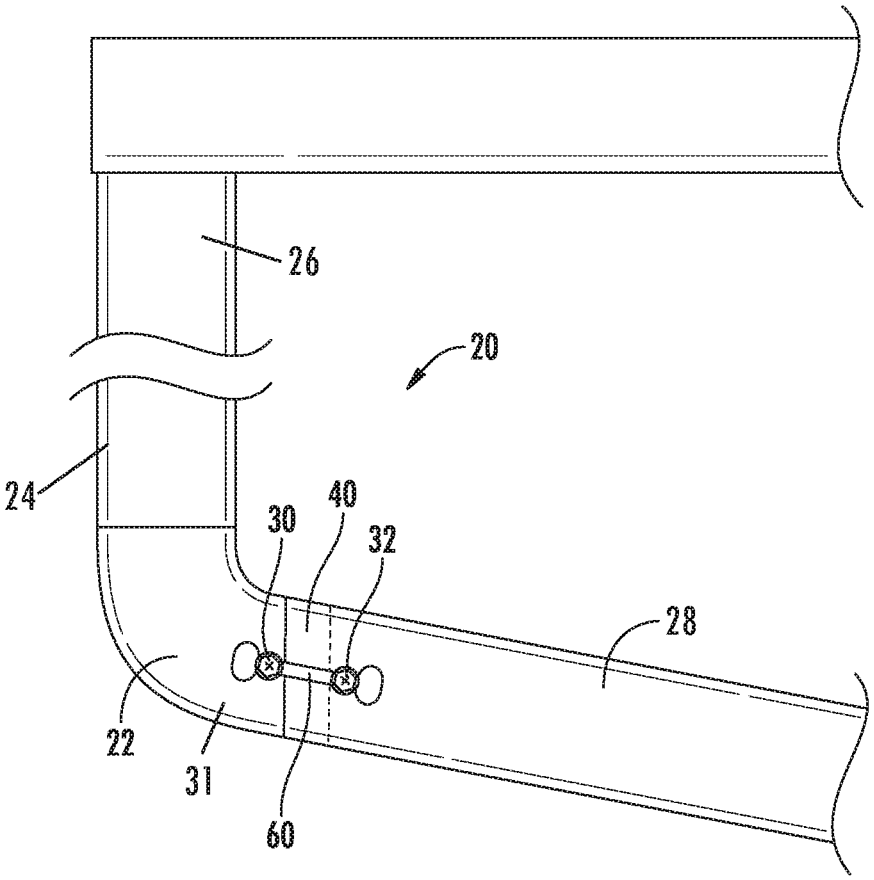
FIG. 1 is a side view of a fastening system attached to an elbow joint of a gutter and a downspout extension.

Now referring to the figures, a gutter fastening system 20 is shown that allows an elbow joint 22 of a standard downspout 24 of a gutter 26 to be securely attached to a downspout extension 28.

In the preferred embodiment, as shown in FIG. 1, a first mounting member 30 is mounted on a first side 31 of the elbow joint 22. The mounting member 30 is located outside of the area of overlap 40. A second mounting member 32 is mounted on the downspout extension 28, again outside of the area of overlap 40. While the mounting members 30 and 32 can be drilled or screwed directly into the elbow joint 22 and downspout extension 28 respectively, the preferred method is to create an opening and then utilize a grommet. The mounting members 30 and 32 are then placed in the respective openings. Additionally, the mounting members 30 and 32 can include an anchor that activates after passing through the openings such that the mounting members 30 and 32 are held in place after placed in the openings. Instead of anchors, a washer and nut could be utilized to hold the mounting members in place.

Figure 4:
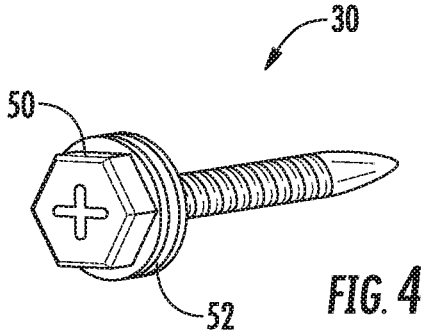
FIG. 4 is a perspective view of a preferred embodiment of a mounting member.

Referring specifically to FIG. 4, a top portion 50 of each mounting member 30 and 32 are preferably a hex head drive with a Philips head configuration. This allows multiple ways to place the mounting members in the openings or grommets. The mounting members 30 and 32 preferably include a groove 52 that can hold a portion of a linkage member 60.

Figure 2:
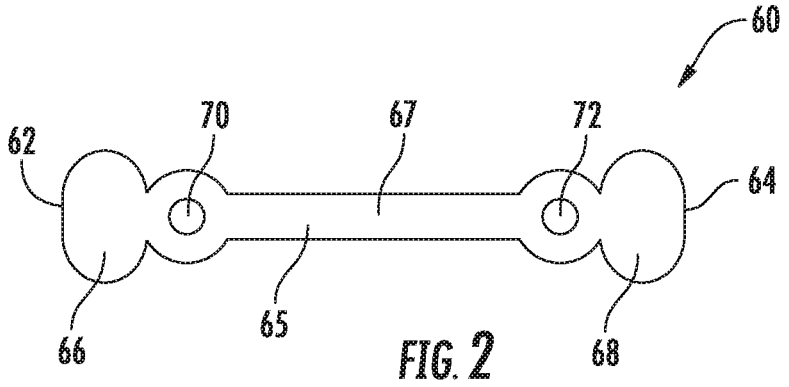
FIG. 2 is a side view of a first embodiment of a linkage member.

A first embodiment of a first linkage member 60, as shown in FIG. 2, has a first end 62 and a second end 64. A main body 65 is elongated and connects the first end 62 and second end 64. The main body 65 has a middle 67. The first end 62 comprises a first tab 66 and the second end 64 comprises a second tab 68, each tab is flexible. A first eyelet 70 is between the first end 62 and the middle 67, and a second eyelet 72 is between the second end 64 and the middle 67. The eyelets 70 and 72 are configured to receive the mounting members 30 and 32, preferably fitting in the grooves 52.

Figure 3:
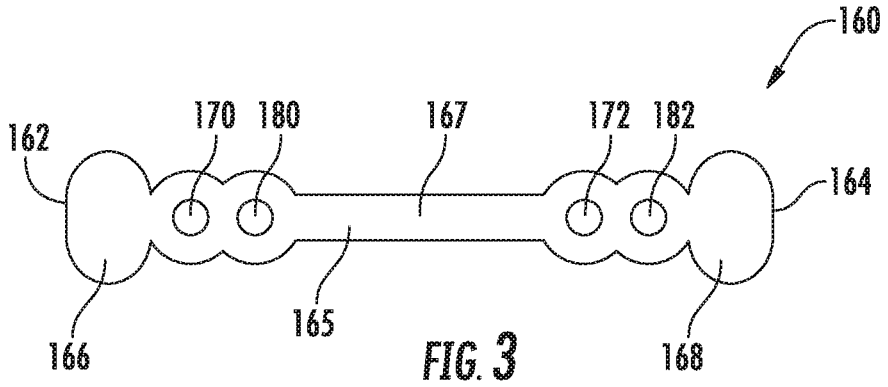
FIG. 3 is a side view of a second embodiment of a linkage member.

A second embodiment of a first linkage member 160, as shown in FIG. 3, has a first end 162 and a second end 164. A main body 65 is elongated and connects the first end 162 and second end 164. The main body 165 has a middle 167. The first end 162 comprises a first tab 166 and the second end 164 comprises a second tab 168. A first eyelet 170 is between the first end 162 and the middle 167, and a second eyelet 172 is between the second end 164 and the middle 167. In the second embodiment, additional eyelets 180 and 182 are added. The eyelets are configured to receive the mounting members, preferably fitting in the grooves 52. The additional eyelets allow the first linkage member 160 to accommodate additional mounting members, therefore, increasing the strength of the connection; or the additional eyelets allow the user to select different lengths to span varying lengths of the area of overlap of the elbow joint and downspout extension. The eyelets 170 and 172 are configured to receive the mounting members 30 and 32, preferably fitting in the grooves 52.

In utilizing the gutter fastening system 20 on an existing elbow joint 22 and downspout extension 28, a user would measure the area of overlap 40 of the elbow joint 22 and downspout extension 28. The user would then select the appropriate length linkage member 60 and measure the distance between the eyelets 70 and 72. Using that distance, the user would then place the mounting members 30 and 32 on the elbow joint 22 and downspout extension 28. As the linkage member 60 is flexible, the user manipulates the linkage member 60 to place the linkage member 60 on the mounting members 30 and 32 with the top portion 50 of the mounting members 30 and 32 protruding through the eyelets 70 and 72. The elbow joint 22 is now secured to the downspout extension 28 and will not fall off during weather events such as rain and wind. To remove the linkage member 60 and therefore be able to remove the downspout extension 28 from the elbow joint 22, the user manipulates at least one tab 66 and 68 of the linkage member 60 to remove it from the eyelets 70 and 72 of the mounting members 30 and 32.

Figure 5:
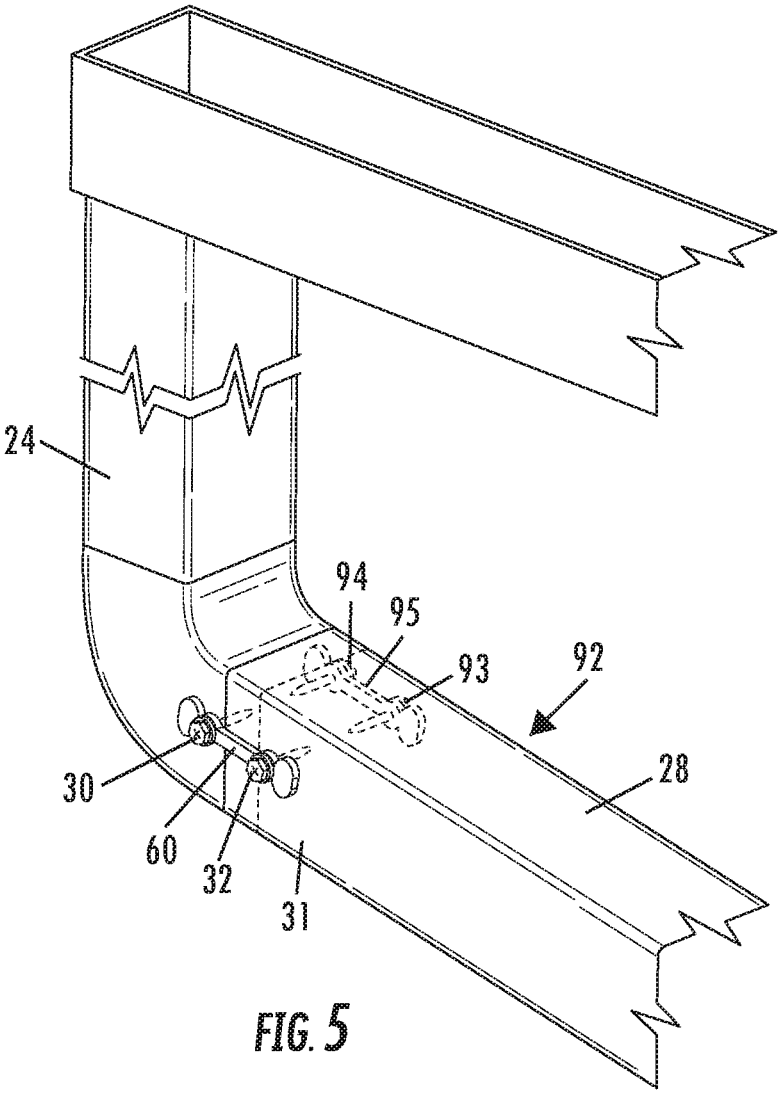
FIG. 5 is a perspective view of the fastening system on an elbow joint of a gutter and a downspout extension.

It is to be appreciated that multiple fastening systems can be utilized, preferably one on a first side 90 of the elbow joint 22 and downspout extension 28, and a second on the opposite side 92. As shown in FIG. 5, a third and fourth mounting member 93, 94 and a second linkage member 95 are utilized on the opposite side. The mounting members 93 and 94 would be identical to mounting members 30 and 32; and the second linkage member 95 would be identical to the one used on the first side 31. They are attached and removed in the same way as described above.

While a variety of shapes, sizes and materials can be used for the linkage member, preferably it is made of rubber or plastic and has the following dimensions. The length from the first end to the second end is preferably 2.5 inches, the thickness is ⅛ of an inch, the eyelets have a ⅜ inch diameter with the holes of the eyelets being ⅛ inch, and the tabs having a 0.5 inch width.

It is also to be appreciated that the gutter fastening system can be sold as a kit with a downspout extension included. The kit would also include the mounting members and the linkage members as described above.

The foregoing description of the invention embodiments has been presented for purposes of illustration and description and is not intended to be exhaustive or to limit the invention to the precise form disclosed. Modifications and variations of the embodiments are possible in light of the above disclosure or such may be acquired through practice of the invention. The embodiments illustrated were chosen in order to explain the principles of the invention and its practical application in order to enable one skilled in the art to utilize the invention in various embodiments and with various modifications as are suited to the particular use contemplated. It is intended that the scope of the invention be defined by the claims appended hereto, and by their equivalents.

What is claimed is:

1. A gutter extension fastening system attachable to an elbow joint of a gutter and a downspout extension of the gutter, comprising:
- a first mounting member configured to be attached to the elbow joint;
- a second mounting member configured to be attached to the downspout extension;
- a linkage member attachable to the first mounting member and the second mounting member;
- wherein the elbow joint is secured to the downspout extension;
- the linkage member is selectively removable from at least one of the first mounting member and the second mounting member;
- the linkage member has a middle, a first end and a second end;
- the first end comprises a flexible tab;
- the linkage member comprises an opening;
- the opening between the middle and the flexible tab;
- at least one of the first mounting member and the second mounting member having a groove;
- the opening selectively attachable to the groove.

2. The gutter extension fastening system of claim 1, wherein:
- the linkage member is selectively removable from the second mounting member.

3. The gutter extension fastening system of claim 2, wherein:
- the second end comprises a flexible tab.

4. The gutter extension fastening system of claim 3, wherein:
- the linkage member comprises a second opening.

5. The gutter extension fastening system of claim 4, further comprising:
- a third mounting member configured to be attached to the elbow joint;
- a fourth mounting member configured to be attached to the downspout extension;
- a second linkage member attachable to the third mounting member and the fourth mounting member;
- the second linkage member on an opposite side of the first linkage member;
- wherein the elbow joint is further secured to the downspout extension.

6. A gutter extension fastening system, comprising:
- a gutter elbow joint;
- a downspout extension;
- a first mounting member configured to be attached to the elbow joint;
- a second mounting member configured to be attached to the downspout extension;
- the gutter elbow joint attachable to the downspout extension;
- an area of overlap is formed when the gutter elbow joint is attached to the downspout extension;
- wherein the first mounting member and the second mounting member are located outside the area of overlap;
- a linkage member attachable to the first mounting member and the second mounting member;
- wherein the elbow joint is secured to the downspout extension;
- the linkage member is selectively removable from at least one of the first mounting member and the second mounting member;
- the linkage member has a middle, a first end and a second end;
- the first end comprises a flexible tab;
- the linkage member comprises an opening;
- the opening between the middle and the flexible tab;
- at least one of the first mounting member and the second mounting member having a groove;
- the opening selectively attachable to the groove.

7. The gutter extension fastening system of claim 6, wherein:
- the linkage member is selectively removable from the second mounting member.

8. The gutter extension fastening system of claim 7, wherein:
- the second end comprises a flexible tab.

9. The gutter extension fastening system of claim 8, wherein:
- the linkage member comprises at least two openings.

10. The gutter extension fastening system of claim 9, further comprising:
- a third mounting member configured to be attached to the elbow joint;
- a fourth mounting member configured to be attached to the downspout extension;
- a second linkage member attachable to the third mounting member and the fourth mounting member;
- the second linkage member on an opposite side of the first linkage member;

wherein the elbow joint is further secured to the downspout extension.

11. A kit for attaching a downspout extension to a downspout of a gutter, wherein the gutter includes an elbow joint, the kit comprising:

a downspout extension;

a first mounting member configured to be attached to the elbow joint;

a second mounting member configured to be attached to the downspout extension;

a linkage member attachable to the first mounting member and the second mounting member;

wherein the elbow joint is secured to the downspout extension;

the linkage member is selectively removable from at least one of the first mounting member and the second mounting member;

the linkage member has a middle, a first end and a second end;

the first end comprises a flexible tab;

the linkage member comprises an opening;

the opening between the middle and the flexible tab;

at least one of the first mounting member and the second mounting member having a groove;

the opening selectively attachable to the groove.

12. The kit of claim 11, wherein:

the second end comprises a flexible tab.

13. The kit of claim 12, wherein:

the linkage member comprises at least two openings.

* * * * *